United States Patent [19]

Gien et al.

[11] Patent Number: 5,065,823

[45] Date of Patent: Nov. 19, 1991

[54] EXTRACTION DEVICE FOR PNEUMATICALLY ACTUATED DRILLING TOOLS

[76] Inventors: Abraham Gien; Bernard L. Gien, both of P.O. Box 471, Edenvale, 1610 Transvall, South Africa

[21] Appl. No.: 640,571

[22] Filed: Jan. 14, 1991

Related U.S. Application Data

[63] Continuation of Ser. No. 414,724, Sep. 29, 1989, abandoned, which is a continuation of Ser. No. 31,378, Mar. 30, 1987, abandoned.

[51] Int. Cl.[5] ..... E02D 9/00

[52] U.S. Cl. ..... 173/91; 173/134

[58] Field of Search ..... 173/91, 125, 134; 175/19

[56] References Cited

U.S. PATENT DOCUMENTS

| | | | |
|---|---|---|---|
| 711,859 | 10/1902 | Holden | 173/125 |
| 3,511,325 | 5/1970 | Schmidt | 173/91 |
| 4,114,950 | 9/1978 | Cooper | 173/91 |

*Primary Examiner*—Douglas D. Watts
*Assistant Examiner*—Scott A. Smith
*Attorney, Agent, or Firm*—McAulay Fisher Nissen Goldberg & Kiel

[57] ABSTRACT

The invention relates to an extraction device used for extracting pneumatically actuated impact tools and the like from boreholes. The device includes a carrier member 1, a reciprocable hammer 2, and a sleeve, 13. The carrier is adapted to be connected to a drill rod secton. Reciprocation of the hammer relative to the carrier may be used to effect extraction. Fluid passages are provided for conveying fluid under pressure through the device in order to cause the hammer to reciprocate.

21 Claims, 1 Drawing Sheet

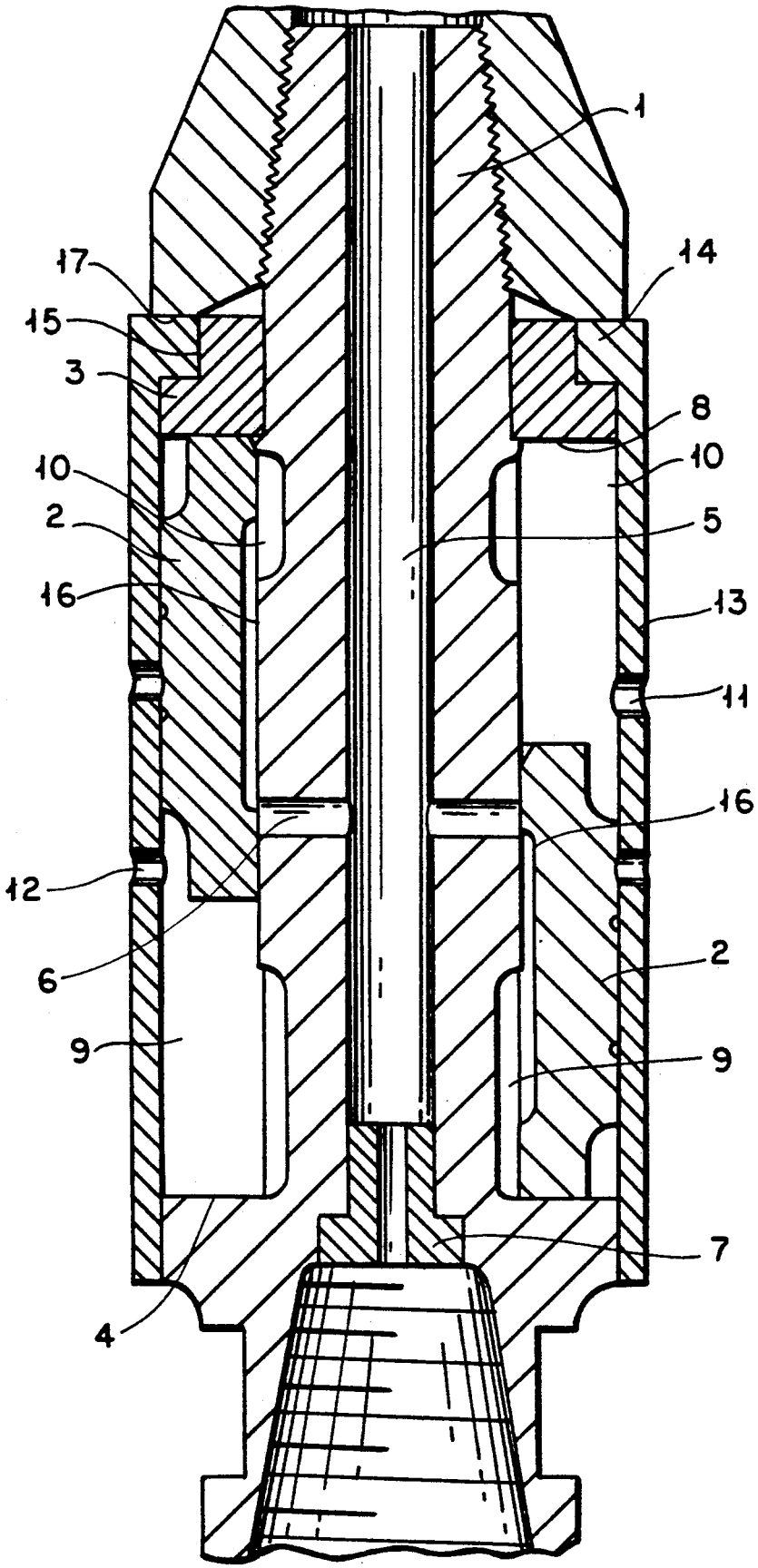
1
17
14
15
3
8
10
10
2
5
16
13
11
16
12
6
2
9
9
7
4

EXTRACTION DEVICE FOR PNEUMATICALLY ACTUATED DRILLING TOOLS

This application is a continuation of application Ser. No. 07/414,724, filed Sept. 29, 1989, now abandoned, which is a Rule 62 continuation of application Ser. No. 07/031,378 filed Mar. 30, 1987, now abandoned.

BACKGROUND OF THE INVENTION

"Down-the-hole" drilling tools are often lost, or are retrieved at a great expense, when they jam down the borehole wherein they are operating. This generally occurs due to excavated material lodging or packing around the drilling tools or around drill rods which supply the operating fluid to the drilling tool. Drill rod sections are in threaded engagement with each other and frequently, attempts to extract the drilling tool by pulling on the drill rod simply causes the threads between individual drill rod sections to shear.

It is an object of this invention to provide means for assisting in the extraction of drill rods and drilling tools from boreholes.

SUMMARY OF THE INVENTION

According to the invention there is provided an extraction device for use in extracting a drill rod and drilling tools from a borehole comprising a hammer carrier adapted to be connected to a drill rod section, the carrier including a striking surface, a hammer reciprocably movable with respect to the carrier between a striking position adjacent the striking surface and a position removed therefrom, fluid flow paths in the carrier and/or the hammer adapted to convey activating fluid to cause reciprocation, momentum of the hammer on striking the striking surface in use being transmitted to the drill rod to urge the drill rod and drilling tool out of the borehole, and a sleeve encapsulating the hammer and defining upper and lower chambers between the inner walls of the sleeve, the hammer carrier, and the upper and lower ends of the hammer respectively, the fluid flow paths directing fluid in use to either the upper or lower chamber depending on the position of the hammer, at least one exhaust port being defined in the wall of the sleeve.

There will preferably be two exhaust ports, spaced apart in a vertical direction.

BRIEF DESCRIPTION OF THE DRAWING

The accompanying drawing has a single FIGURE shows an extraction device according to the invention, the drawing being a cross-sectional side view of the device, the left hand side of the drawing showing the hammer in a striking position and the right hand side of the drawing showing the hammer in a position removed from the striking position.

DESCRIPTION OF THE PREFERRED EMBODIMENT

Referring to the drawing, the extraction device shown includes a tubular carrier member 1 which carries a sleeve hammer 2, the hammer being movable between upper and lower stop formations numbered 3 and 4 respectively. The upper stop: formation 3 is in the form of a collar secured to the carrier member 1 and the lower stop formation 4 is formed by an enlarged lower end of the carrier member. The upper stop formation defines a striking surface 8 for the hammer.

An axial bore 5 passes down the centre of the carrier member for conveying activating fluid. Lateral ports 6 are formed in the carrier member for conveying fluid from the axial bore 5 to the hammer 2. A constriction plug 7 limits the rate of excess fluid which can pass through the device.

A sleeve 13 is mounted to the carrier member and encapsulates the hammer. The sleeve has an inwardly directed flange 14 on the upper end thereof which locates in a recess 15 in the collar 3 and shoulder 17 of carrier member 1 cooperates with flange 14 to mount the collar 3. The lower end of the sleeve 13 engages with the enlarged end 4 of the carrier member.

The sleeve, carrier member, and hammer together define an upper chamber 10 and a lower chamber 9. The hammer has a recess 16 in the inner wall thereof for conveying fluid from the lateral ports 6 to the chambers.

The sleeve 13 has upper and lower exhaust ports, numbered 11 and 12 respectively.

Referring initially to the left hand side of the drawing, the hammer is shown in its striking position in striking contact with the striking surface 8. In this position fluid under pressure is conveyed through lateral port 6, through recess 16 to the upper chamber 10. This fluid will urge the hammer away from the striking surface 8. It will be noted that the lower chamber 9 is open to atmosphere through exhaust port 12 whilst the hammer is in this striking position, and the pressure in this lower chamber is thus low.

When the hammer is in the lower position as shown in the right hand side of the drawing, the lower chamber 9 is sealed and fluid under pressure is introduced into the lower chamber through lateral ports 6 and recess 16. The upper chamber, with the hammer in this position is open to atmosphere through upper exhaust port 11. The high pressure fluid will urge the hammer upwards towards the striking surface 8.

It will be appreciated that the hammer will automatically reciprocate between the two extreme positions resulting in drilling tools to which the device is secured being extracted from a drilling hole in use.

What is claimed is:

1. An extracting device for use in extracting a drill rod and a drilling tool from a borehole, comprising:

a hammer carrier having at one end means for connecting it to a drill rod section, said carrier including an annular striking surface remote from said connecting means and having an axial bore for conveying activating fluids;

an annular hammer having upper and lower ends reciprocably movable with respect to the carrier between a striking position adjacent said striking surface and a position removed therefrom;

fluid flow paths including a lateral port in said carrier extending through the wall of said carrier from the axial bore for conveying the activating fluid to said hammer to cause reciprocation, momentum of said hammer on striking the striking surface in use being transmitted to said drill rod to urge said drill rod and the drilling tool out of the borehole; and a sleeve surrounding said hammer and defining upper and lower chambers between inner walls of said sleeve, said hammer carrier, and said upper and lower ends of said hammer respectively, said fluid flow paths including a recess in the inner wall of the hammer and a recess in the outer wall of said carrier on each side of the lateral port for directing fluid in use to either said upper or said lower chamber, depending upon the position of the hammer, and said sleeve having at least one exhaust port opening outwardly through the wall thereof and being free of an intake port;

said annular striking surface being provided by a collar held on said carrier by said sleeve and against a shoulder on said carrier by a flange on the end of the sleeve engaging in a recess provided in the outer surface of the collar.

2. The extraction device according to claim 1, including at least one lateral port extending from said axial bore.

3. The extraction device according to claim 1, wherein said fluid flow paths include recesses in the outer wall of the hammer at the ends thereof.

4. The extraction device according to claim 1, wherein two exhaust ports are provided through the wall of the sleeve and are located one on each side of the lateral port.

5. The extraction device according to claim 1, including constriction means for limiting the rate of excess fluid which can flow through the device.

6. The extraction device according to claim 5, wherein said constriction means includes a constriction plug.

7. The extraction device according to claim 6, wherein the plug is located in the axial bore through said carrier downstream of the lateral port.

8. The extraction device according to claim 1, wherein the hammer is reversible in position on said carrier.

9. The extraction device according to claim 1, wherein said at least one exhaust port extends in a direction transverse to an axis passing through said upper and lower ends.

10. An extracting device for use in extracting a drill rod and a drilling tool from a borehole, comprising:

a hammer carrier having at one end means for connecting it to a drill rod section, said carrier including an annular striking surface remote from said connecting means and having an axial bore for conveying activating fluids;

an annular hammer having upper and lower ends reciprocably movable with respect to the carrier between a striking position adjacent said striking surface and a position removed therefrom;

fluid flow paths including a lateral port in said carrier extending through the wall of said carrier from the axial bore for conveying the activating fluid to said hammer to cause reciprocation, momentum of said hammer on striking the striking surface in use being transmitted to said drill rod to urge said drill rod and the drilling tool out of the borehole; and a sleeve surrounding said hammer and defining upper and lower chambers between inner walls of said sleeve, said hammer carrier, and said upper and lower ends of said hammer respectively, said fluid flow paths including a recess in the inner wall of the hammer and a recess in the outer wall of said carrier on each side of the lateral port for directing fluid in use to either said upper or said lower chamber, depending upon the position of the hammer, and said sleeve having at least one exhaust port opening outwardly through the wall thereof and being free of an intake port;

a collar located against a shoulder on said carrier and having a recess, and an inwardly directed flange on the upper end of said sleeve receivable in said recess.

11. The extraction device of claim 10, wherein said hammer carrier has an end adapted to be connected to an adapter of said drill rod section, said flange being in engagement with said adapter so that when said piston strikes upwards, the piston blow is transferred via said collar through said sleeve to the adapter.

12. The extraction device according to claim 10, wherein said at least one exhaust port is transversely oriented to the longitudinal axis of said device for exhausting to the atmosphere.

13. The extraction device of claim 10, wherein said sleeve is provided with two spaced apart exhaust ports, said lateral port located between said two exhaust ports, and said exhaust ports being transversely oriented to the longitudinal axis of said device, and said exhaust ports open outwardly transversely through said sleeve.

14. The extraction device as claimed in claim 13, wherein said two spaced apart exhaust ports are vertically spaced apart exhaust ports.

15. The extraction device according to claim 10, including at least one lateral port extending from said axial bore.

16. The extraction device according to claim 10, wherein said fluid flow paths include recesses in the outer wall of the hammer at the ends thereof.

17. The extraction device according to claim 10, wherein two exhaust ports are provided through the wall of the sleeve and are located one on each side of the lateral port.

18. The extraction device according to claim 10, including constriction means for limiting the rate of excess fluid which can flow through the device.

19. The extraction device according to claim 10, wherein the hammer is reversible in position on said carrier.

20. An extraction device for use in extracting a drill rod and a drilling tool from a borehole, comprising:

a hammer carrier having an end adapted to be connected to a drill rod section, said carrier including a striking surface, and said carrier having an enlarged end;

a hammer having upper and lower ends reciprocably movable with respect to the carrier between a striking position adjacent said striking surface and a position removed therefrom;

fluid flow paths including an unencumbered central bore in said carrier for conveying activating fluid to cause reciprocation, momentum of said hammer on striking the striking surface in use being transmitted to said drill rod to urge said drill rod and the drilling tool out of the borehole;

a sleeve encapsulating said hammer and defining upper and lower chambers between inner walls of said sleeve, said hammer carrier, and said upper and lower ends of said hammer respectively, said fluid flow paths directing fluid in use to either said upper or lower chamber depending on the position of the hammer, and said sleeve having in the wall thereof two exhaust ports, at least one of said exhaust ports extending outwardly therefrom through a radial channel transversely oriented to the longitudinal axis of said device for exhausting to the atmosphere and the lower end of said sleeve engaging with said enlarged end of said carrier;

said one of said exhaust ports forming a lower exhaust port and the other of said exhaust ports forming an upper exhaust port, and lateral ports communicating with said axial bore, said lateral ports being between said exhaust ports and being transversely oriented to the longitudinal axis of said device, and said exhaust ports open outwardly transversely through said sleeve;

a collar having a recess and an inwardly directed flange on the upper end of said sleeve receivable in said recess and a shoulder on said carrier member cooperating with said flange to mount said collar; and a constriction plug for limiting the rate of excess fluid which can pass through the device.

21. An extracting device for use in extracting a drill rod and a drilling tool from a borehole, comprising:

a hammer carrier having at one end means for connecting it to a drill rod section, said carrier including an annular striking surface remote from said connecting means and having an axial bore for conveying activating fluids;

an annular hammer having upper and lower ends reciprocably movable with respect to the carrier between a striking position adjacent said striking surface and a position removed therefrom;

fluid flow paths including a lateral port in said carrier extending through the wall of said carrier from the axial bore for conveying the activating fluid to said hammer to cause reciproction, momentum of said hammer on striking the striking surface in use being transmitted to said drill rod to urge said drill rod and the drilling tool out of the borehole; and a sleeve surrounding said hammer and defining upper and lower chambers between inner walls of said sleeve, said hammer carrier, and said upper and lower ends of said hammer respectively, said fluid flow paths including a recess in the inner wall of the hammer and a recess in the outer wall of said carrier on each side of the lateral port for directing fluid in use to either said upper or said lower chamber depending on the position of the hammer and said sleeve having at least one exhaust port opening outwardly through the wall thereof and being free of an intake port; and a collar having a recess and an inwardly directed flange on the upper end of said sleeve receivable in said recess, said collar being located against a shoulder on said carrier by said flange on the end of the sleeve engaging in said recess provided by an outer surface of the collar.

* * * * *